United States Patent [19]

Nakamura

[11] 4,407,350

[45] Oct. 4, 1983

[54] APPARATUS FOR STRETCHING AND LINKING A VERTICAL BLIND SLAT-CLOTH

[75] Inventor: Toshihiro Nakamura, Tokyo, Japan

[73] Assignee: Toso Kabushiki Kaisha, Tokyo, Japan

[21] Appl. No.: 374,721

[22] Filed: May 4, 1982

[30] Foreign Application Priority Data

May 13, 1981 [JP] Japan ..... 56-67971[U]

[51] Int. Cl.[3] ..... E06B 9/38

[52] U.S. Cl. ..... 160/178 R

[58] Field of Search ..... 160/166, 168, 172, 173, 160/176, 177, 178 R

[56] References Cited

U.S. PATENT DOCUMENTS

| | | | |
|---|---|---|---|
| 2,849,063 | 8/1958 | Achler et al. | 160/177 |
| 3,298,425 | 1/1967 | Cryton et al. | 160/178 R |
| 3,500,896 | 3/1970 | Endou | 160/178 R |
| 4,356,855 | 11/1982 | Molzer | 160/178 R |
| 4,361,179 | 11/1982 | Benthin | 160/176 |

*Primary Examiner*—Peter M. Caun

*Attorney, Agent, or Firm*—Birch, Stewart, Kolasch & Birch

[57] ABSTRACT

A weight-case of a synthetic resin material for containing a weight of a metallic plate together with the bottom part of a slat-cloth has as one body a top guide for guiding the slat-cloth to turn about and let in the weight-case, a pair of L-shaped legs for preventing the slat-cloth from being dragged on the floor, and a pair of T-shaped pins for coupling engagement with couplers secured to a kinitted linking cord. Each coupler has a C-shaped gripper for removably fitting engagement with the T-shaped pin and a W-shaped hook for anchoring engagement with one of serially knitted eyelets in the linking cord. The C-shaped gripper is advantageously separable from the T-shaped pin to protect the linking elements against damage when the cord is accidentally trodden or forcibly drawn in use.

7 Claims, 5 Drawing Figures

APPARATUS FOR STRETCHING AND LINKING A VERTICAL BLIND SLAT-CLOTH

BACKGROUND OF THE INVENTION

The invention relates to apparatus for stretching and linking a vertical blind slat-cloth and more particularly to apparatus of the type having a weight for stretching the slat-cloth and a weight-case for housing the weight together with the bottom part of the slat-cloth and connecting the same to a linking cord.

A vertical blind has a plurality of vertical slats movably supported on a head-rail, each slat including a top hanger and a slat-cloth suspended from the top hanger, and an apparatus for stretching the slat-cloth and connecting the bottom part of the slat-cloth to linking cords. The cord is arranged to keep the slats from moving too far away from each other while at the same time giving the slats sufficient freedom to move within a normal range.

The known apparatus has a weight of a metallic plate enveloped in the bottom part of the slat-cloth to give an extension thereto and a belt of a synthetic resin material to fasten the weight and the slat-cloth together and connect the same directly to the cord, the belt being provided on the both sides thereof with slits and hooks for coupling engagement with the weight and the cord.

However, the known apparatus has disadvantages, one of which is that, when the cord is accidentally trodden or forcibly drawn in use, the hook or slit in the belt is easy to break, otherwise the cord will be broken. Another disadvantage is that the slat-cloth is dragged on the floor when it is lengthened through use.

It is the primary object of the invention to provide an improved apparatus free from the disadvantages as described above. This and other objects of the invention will be seen by reference to the description, taken in connection with the accompanying drawings.

SUMMARY OF THE INVENTION

In accordance with the invention, the apparatus comprises a weight of a metallic plate, a weight-case of a synthetic resin material for housing the weight together with the bottom part of the slat-cloth, a top guide integrally molded with the weight-case for guiding the slat-cloth to turn about and let in the weight-case, a pair of legs integrally molded with the weight-case for preventing the slat-cloth from being dragged on the floor, and a pair of couplers each having one portion thereof integrally molded with the weight-case and the other portion secured to a linking cord. The coupling portion on the weight-case is desirable to be T-shaped or U-shaped pin for removably fitting engagement with a C-shaped gripper of the other coupling portion.

The advantages offered by the invention are mainly that none of the linking elements, such as the weight-case, the linking cord and the coupler therebetween, are damaged when the cord is accidentally trodden or forcibly pulled in use. Another advantage is that the slat-cloth is never draggled on the floor when it is lengthened through use. The couplers, once disengaged from each other, are advantageously easy to be reset on each other.

BRIEF DESCRIPTION OF THE DRAWINGS

One way of carrying out the invention is described in detail below with reference to drawings which illustrate only one specific embodiment, in which.

Figure 1:
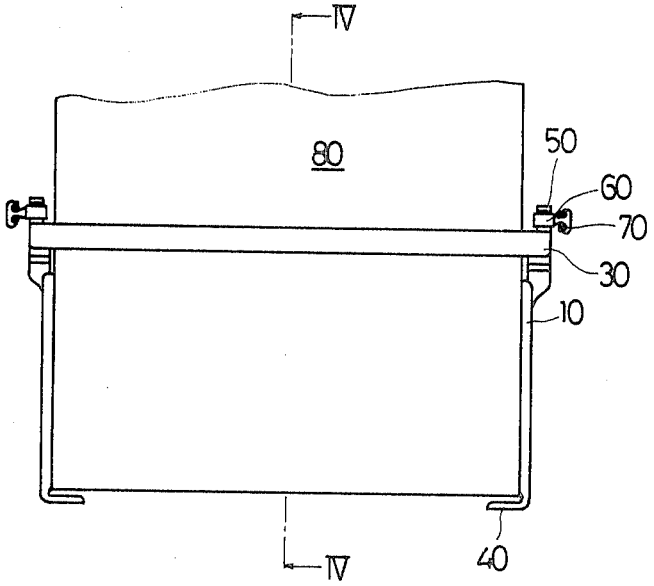
FIG. 1 is a front elevation of the relevant portion of vertical blind slat equipped with the apparatus of the invention.

The figures show an apparatus of the invention comprising a weight 20 of a metallic plate, a weight-case 10 of a synthetic resin material, a top guide 30 integrally molded with the weight-case, a pair of legs 40 integrally molded with the weight-case, a pair of coupling pins 50 integrally molded with the weight-case, and couplers 60 secured to a linking cord 70. A slat-clot 80 for use in a vertical blind is vertically suspended from a non-illustrated slat-hanger, which is rotatably and slidably supported on a blind head-rail. The apparatus is mounted on the bottom part of the slat-cloth 80, as seen in FIG. 1.

Figure 2:
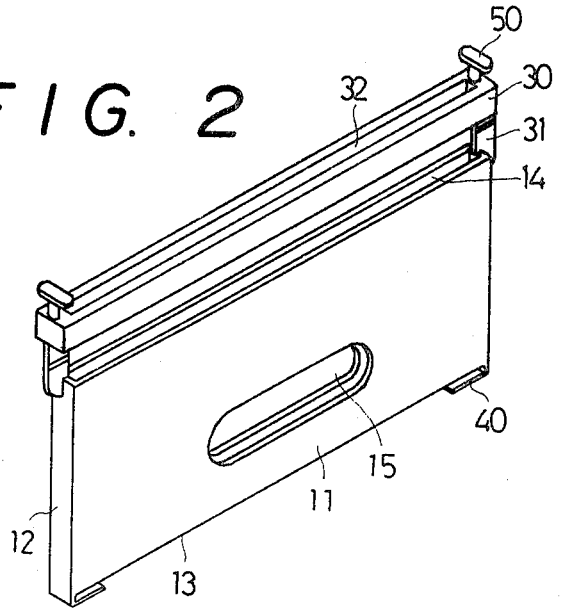
FIG. 2 is a perspective view of the weight-case.

As seen in FIG. 2, the weight-case 10 has narrowly spaced front and rear walls 11, widely spaced side walls 12, and a bottom wall 13 to define a thin inside space with a top opening 14. The top guide 30 is connected to the upper ends of the both side walls 12 with the intervention of flexible supports 31 and formed with a narrow slit 32. The both L-shaped legs 40 are connected to the both side ends of the bottom wall 13. T-shaped pins 50 stand upright on the both upper ends of the top guide 30. The front and rear walls 11 are provided with the respective windows 15.

Figure 3:
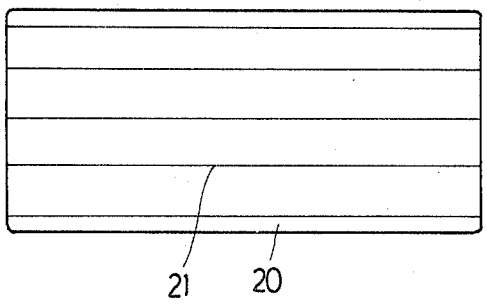
FIG. 3 is a front elevation of the weight.
Figure 4:
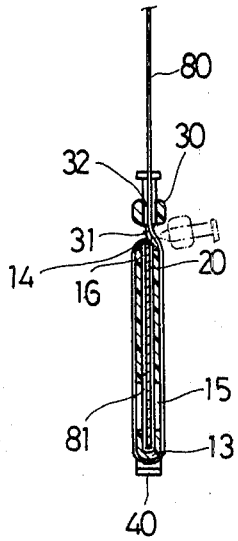
FIG. 4 is a side section taken along the line IV—IV of FIG. 1.

The bottom part 81 of the slat-cloth 80 passes through slit 32 in top guide 30 and then turns about the weight-case 10 before entering inside space 16 through top opening 14, as seen in FIG. 4. Horizontal scale 21 is indicated on the surface of weight 20 and utilized to adjust the hanging length of the slat-cloth, as seen in FIG. 3. Top opening 14 and slit 32 are slightly wider than slat-cloth 80. Supports 31 are so bendable as to turn the top guide 30 aside and permit easy insertion of weight 20 with the bottom part 81 into inside space 16 through top opening 14, as seen by dotted lines in FIG. 4. The weight 20 projects slightly upwardly from top opening 14 because of being higher than inside space 16 in weight-case 10. The slat-cloth 80 is put between the bottom wall 13 and the leg 40 and protected against contact with the floor by the leg 40.

Figure 5:
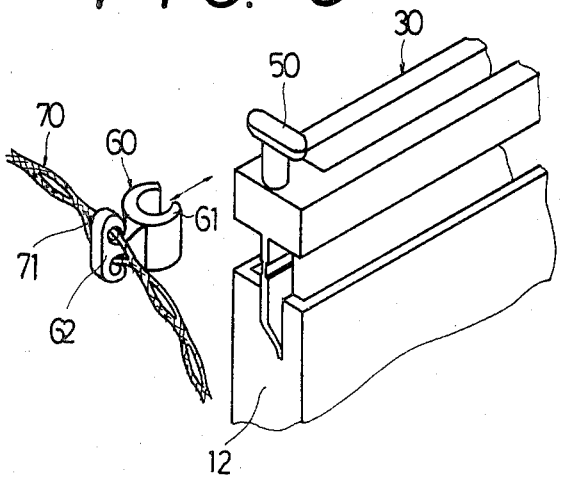
FIG. 5 is an enlarged perspective view of the coupler between the weight-case and the cord.

As seen in FIG. 5, the knitted cord 70 has a series of eyelets 71 aligned at intervals of relatively small distance. The coupler 60 has a C-shaped gripper 61 to be fitted on a T-shaped pin 50 on top guide 30 and a W-shaped hook 62 anchored in one of serially knitted eyelets 71 in the linking cord 70. The coupler 60 is movable within an eyelet 71 but can not slip out of the eyelet. Couplers are mounted on a cord at intervals corresponding to the maximum distance between the adjacent slats. Each coupler 60 is horizontally rotatable about T-shaped pin 50 but vertically unmoved relative to the pin. T-shaped pin may be replaced by a U-shaped pin and stand laterally on either of the top guide and the side wall 12.

It is easy to set up the appartus of the invention: The bottom part 81 is firstly passed through slit 32 in top guide 30 and slackly turned about weight-case 10 inside legs 40. Then, it is put on a preselected scale 21 and adhered onto weight 20. The bottom part with weight 20 is inserted in inside space 16 through top opening 14 while top guide 30 is turned aside as shown by dotted lines in FIG. 4. Finally, slat-cloth 80 about weight-case 10 is pulled up and tightened.

It is also easy to remove the apparatus from the slat: The slat-cloth 80 about weight-case 10 is firstly loosened. Then, weight 20 with the bottom part 81 is pushed up and slipped out of top opening 14 by finger's operation through windows 15 while top guide 30 is turned aside as shown by dotted lines in FIG. 4.

In use, slat-cloth 80 is stretched out by weight 20 in weight-case 10 and prevented from laterally slipping out of weight-case 10 and being dragged on the floor by L-shaped legs 40, so that slat-cloth 80 is protected against damage even if it is lengthened through use.

When cord 70 is accidentally trodden or hitched by something moving away from the slat, an extraordinary force acts on it and causes C-shaped gripper 61 to separate from T-shaped pin 50 on top guide 30 before it is forcibly broken. Therefore, the force gives no damage to any of cord 70, coupler 60, pin 50 and support 31. Whenever gripper 61 is disengaged from pin 50, it is easily and quickly reset on the respective pin, as shown by an arrow in FIG. 5.

What is claimed is:

1. Apparatus for stretching and linking a vertical blind slat-cloth comprising a weight of a metallic plate, a weight-case of a synthetic resin material for housing said weight together with the bottom part of a slat-cloth, said weight-case having narrowly spaced front and rear walls, widely spaced both side walls, and a bottom wall to define a thin inside space with a top opening, said inside space and said top opening being slightly wider than the slat-cloth, a top guide integrally formed with said weight-case and connected to said both side walls with the intervention of flexible supports, said top guide being formed with a slit slightly wider than the slat-cloth, said support being forwardly and rearwardly bendable, a pair of legs integrally formed with said weight-case and projecting from either of said top guide and said weight-case, a pair of coupling pins integrally formed with said weight-case, and couplers secured to linking cords each being adapted to be removably connected to said coupling pin.

2. Apparatus as claimed in claim 1, wherein said weight is scaled on the surface thereof.

3. Apparatus as claimed in claim 1, wherein said coupler has a C-shaped gripper for coupling engagement with said coupling pin and a W-shaped hook for anchoring engagement with said linking cord.

4. Apparatus as claimed in claim 3, wherein said coupling pin is T-shaped and projects from either of said side wall of said weight-case and said top guide.

5. Apparatus as claimed in claim 4, wherein said coupling pin stands upright on the upper end of said top guide.

6. Apparatus as claimed in claim 3, wherein said coupling pin is U-shaped and projects from either of said side wall of said weight-case and said top guide.

7. Apparatus as claimed in claim 3, wherein said linking cord has a series of knitted eyelets for fixing engagement with said W-shaped hook.

* * * * *